United States Patent [19]

Dee et al.

[11] Patent Number: 4,808,123

[45] Date of Patent: Feb. 28, 1989

[54] SELF-LOCKING STRAIN-RELIEF END BELL FOR ELECTRICAL CONNECTOR ASSEMBLY

[75] Inventors: James S. Dee, Yorba Linda; Thomas J. Bell, Costa Mesa, both of Calif.

[73] Assignee: Diverse Termination Products, Inc., Placentia, Calif.

[21] Appl. No.: 10,848

[22] Filed: Feb. 4, 1987

[51] Int. Cl.[4] ..... H01R 13/58

[52] U.S. Cl. ..... 439/470; 439/321

[58] Field of Search ..... 439/312–323, 439/470–473

[56] References Cited

U.S. PATENT DOCUMENTS

| | | | |
|---|---|---|---|
| 3,552,777 | 1/1971 | Heinrich et al. | 285/81 |
| 3,678,439 | 7/1972 | Vetter | 339/46 |
| 3,750,087 | 7/1973 | Vetter | 339/90 R |
| 3,869,186 | 3/1975 | Vetter | 339/89 R |
| 3,880,490 | 4/1975 | Belmont | 439/472 |
| 4,030,798 | 6/1977 | Paoli | 339/89 R |
| 4,255,008 | 3/1981 | Snyder et al. | 339/89 M |
| 4,407,529 | 10/1983 | Holmen | 285/82 |
| 4,508,407 | 4/1985 | Ball | 339/89 R |
| 4,564,255 | 1/1986 | Kirma | 439/471 |
| 4,588,245 | 5/1986 | Schwartz et al. | 339/89 R |
| 4,588,246 | 5/1986 | Schildkraut et al. | 339/89 R |
| 4,648,670 | 3/1987 | Punako et al. | 339/89 R |
| 4,648,671 | 3/1987 | Torban et al. | 339/89 R |

FOREIGN PATENT DOCUMENTS

| | | | |
|---|---|---|---|
| 1389839 | 1/1965 | France | 439/321 |
| 1045162 | 10/1966 | United Kingdom . | |

*Primary Examiner*—J. Patrick McQuade

*Attorney, Agent, or Firm*—Klein & Szekeres

[57] ABSTRACT

A strain-relief end bell for an electrical connector assembly includes a ratcheting mechanism that allows the end bell to resist vibration-induced decoupling once it is threaded onto an electrical connector. The ratcheting mechanism includes a retainer ring that is seated between an internally-threaded coupling ring and an annular fitting around which the coupling ring is rotatably mounted. The retainer ring is fixed to the coupling ring so that both rings are rotatable together. The inner peripheral edge of the retainer ring has a plurality of equidistantly-spaced detents that engage a plurality of rotational bearings on the annular fitting as the coupling ring and the retainer ring are rotated with respect to the annular fitting. The engagement between the detents and the bearings creates a ratcheting effect that restrains the coupling ring from rotating with respect to the fitting unless a manual effort is applied to it. The retainer ring also restrains the coupling ring from axial movement with respect to the annular fitting.

13 Claims, 1 Drawing Sheet

SELF-LOCKING STRAIN-RELIEF END BELL FOR ELECTRICAL CONNECTOR ASSEMBLY

BACKGROUND OF THE INVENTION

This invention relates generally to the field of connection devices for electrical cables and the like. In particular, it relates to a self-locking, strain-relief end bell for use in such connection devices.

Typically, an electrical cable connection assembly comprises a male connector, a female connector, a coupling ring or nut that couples the male and female connectors, and a strain-relief member or "end bell" for each of the connectors.

There are several important considerations in designing connector assemblies. First, the connectors must be capable of being quickly and easily coupled and decoupled without special tools, and with the use of no more than moderate manual effort. Second, the connectors, once coupled, must maintain good electrical contact with each other. In the aerospace field, this second consideration dictates that such connector assemblies must be able to withstand severe vibrational forces without uncoupling. To this end, the connector industry has devised a number of connector assembly designs in which the coupling ring or nut has a self-locking, or anti-decoupling, mechanism for the purpose of resisting vibration-induced decoupling. These self-locking mechanisms typically employ ratcheting means between the coupling nut and one of the connectors for allowing the coupling nut to move more easily in the coupling or tightening direction than in the decoupling or loosening direction.

The following United States patents exemplify the approaches taken by the prior art in this area: U.S. Pat. Nos. 3,552,777-Heinrich et al.; 3,678,439- Vetter; 3,750,087- Vetter; 3,869,186- Vetter; 4,030,789- Paoli; 4,255,008- Snyder et al.; 4,407,529- Holman; 4,508,407-Ball; 4,588,246-Schildkraut et al.; and 4,588,245-Schwartz et al.

While prior art anti-decoupling mechanisms for success, several shortcomings have been noted. For example, some prior art devices may require excessive manual effort for decoupling. Others may exhibit a tendency to fail after a number of coupling/decoupling operations. Several achieve satisfactory results, but only with relatively complex mechanisms that are costly to manufacture.

Moreover, the prior art has focused on the coupling between the two connectors. By and large, the interface between each connector and its associated strain-relief end bell has been ignored. To date, therefore, there has been no satisfactory way devised to minimize vibration-induced decoupling between the end bell and the connector. The typical end bell comprises a cable clamp that attaches to the connector by an internally-threaded coupling ring. This arrangement is prone to vibration-induced decoupling. To prevent such decoupling, some mechanics have developed the practice of securing the end bell to the connector with a length of wire. A serious problem with this practice, however, is that a piece of the wire occasionally works loose or falls off, with the possibility of causing a short circuit if it lodges in contact with other electrical components.

Accordingly, there has been a long-felt, but as yet unmet need for a strain-relief end bell that has a simple, yet reliable, anti-decoupling feature. Moreover, there is a need for such a self-locking end bell that is not appreciably larger or heavier than conventional end bells, especially in the aerospace industry, where minimizing weight is always a vital concern. Furthermore, an end bell with these features should also be relatively simple and economical to manufacture.

SUMMARY OF THE INVENTION

Broadly, the present invention is a self-locking, or anti-decoupling strain-relief end bell for an electrical connector, wherein the anti-decoupling mechanism comprises ratcheting means, operatively associated with the end bell coupling ring, for providing a plurality of detented rotational positions for the coupling ring, while also restraining the axial movement of the coupling ring relative the rest of the end bell.

More specifically, the present invention comprises an end bell with a strain-relief cable clamp attached to an annular fitting, with the coupling ring rotatably disposed around the exterior surface of the fitting. The ratcheting means, operative between the exterior surface of the fitting and the interior surface of the coupling ring, includes a retainer ring seated around the exterior surface of the fitting and having a plurality of detents spaced around its inner periphery. The detents are engaged by bearing means disposed around the exterior surface of the annular fitting. In a preferred embodiment of the invention, the bearing means are a plurality of ball bearings, each contained in one of a plurality of sockets spaced around the outer periphery of the fitting. The retainer ring is seated in registering peripheral grooves in the inner surface of the coupling ring and the outer surface of the fitting, so that fitting is substantially prevented. The retainer ring is also fixed in the groove in the coupling ring, so that the retainer ring and the coupling ring turn together.

In use, the coupling ring of the end bell is threaded onto the distal end of the connector in the usual manner, except that as the coupling nut is tightened, the detents on the retainer ring engage the bearings in the fitting to provide a ratcheting action. Continued tightening causes the fitting to compress the elastomeric insulator/seal that protrudes from the distal end of the connector receptacle. Because of the ratcheting effect provided by the engagement between the detents and the bearings, the coupling ring is restrained from rotation unless a manual effort is applied to turn it. Thus, the end bell is restrained from backing off under the pressure of the compressed insulator/seal. Of equal importance, the assembly is capable of withstanding severe vibration and shock without any substantial loosening of the end bell. Nevertheless, the end bell can be manually loosened with only moderate effort.

As will be better appreciated from the detailed description which follows, the present invention has a number of advantages. First, as mentioned above, it provides an end bell that effectively resists vibration-induced decoupling. Furthermore, this function is accomplished by an end bell that is not significantly larger in its outside dimensions than a conventional end bell for the same size connector. This feature allows easy substitution of the end bell of the present invention for conventional end bells without substantial modifications of bulkheads, partitions, housings, etc., wherein the cable connectors are located. In addition, these functional advantages are achieved with a structure that is relatively simple and economical to manufacture. Moreover, this structure provides a high degree of reliability and durability, providing an effective anti-decoupling function even after a great number of coupling-/decoupling operations.

DETAILED DESCRIPTION OF THE INVENTION

Figure 1:
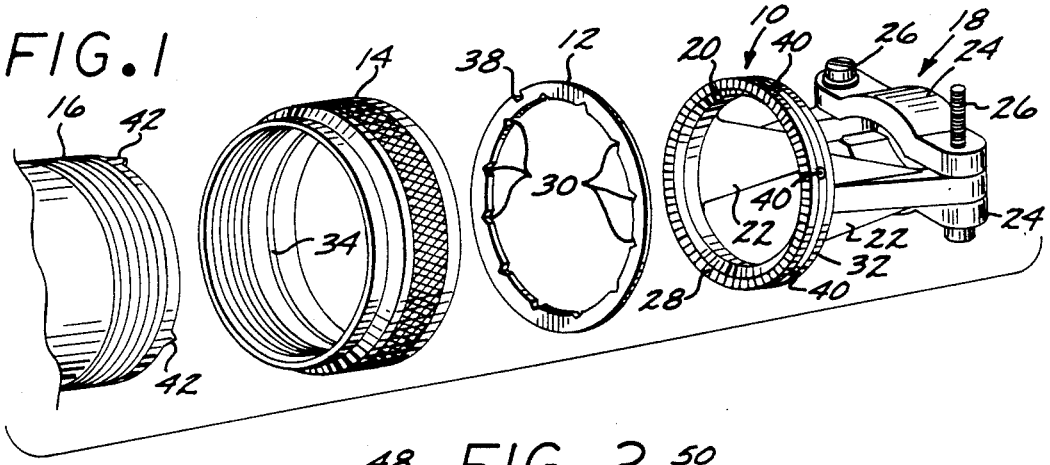
FIG. 1 is an exploded perspective view of a preferred embodiment of the present invention, showing its relationship to the distal end of a typical connector receptacle.

Referring now to the drawings, a preferred embodiment of the present invention will now be described.

FIG. 1 illustrates the major components of a self-locking, strain-relief end bell in accordance with the present invention. The end bell comprises a strain-relief member 10, a clutch ring or retainer ring 12, and an internally-threaded coupling ring 14. Also shown in FIG. 1 is the distal end of cable connector receptacle 16. As can also be seen in FIG. 1, the strain relief member 10 comprises a cable clamp 18 of conventional design, attached to the distal edge of an annular fitting 20 by a pair of axially-extending, diametrically-opposed ears 22. The cable clamp 18, being conventional, need not be described in detail. For the sake of completeness, however, it may briefly be described as comprising a pair of arcuate clamping elements 24 attachable to the distal ends of the ears 22 by screws 26.

In the preferred embodiment of the invention, the annular fitting 20 has a serrated proximal edge 28, as best shown in FIG. 1. The purpose of the serrated edge 28 will be explained below.

Figure 3:
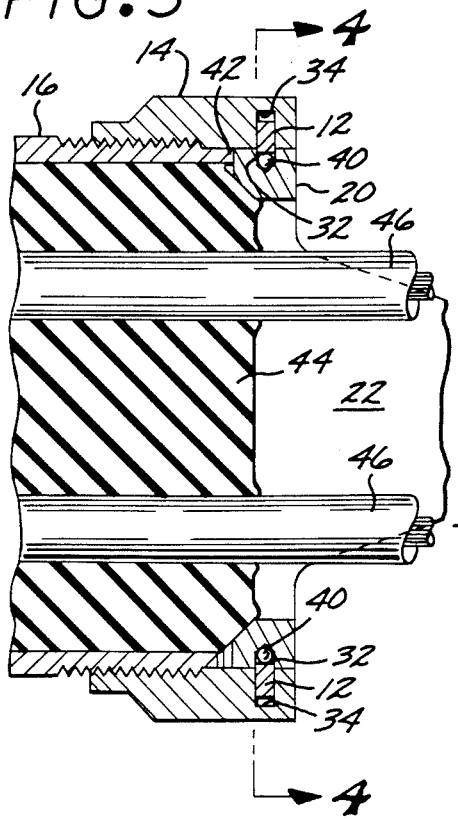
FIG. 3 is a cross-sectional view along line 3—3 of FIG. 2.
Figure 4:
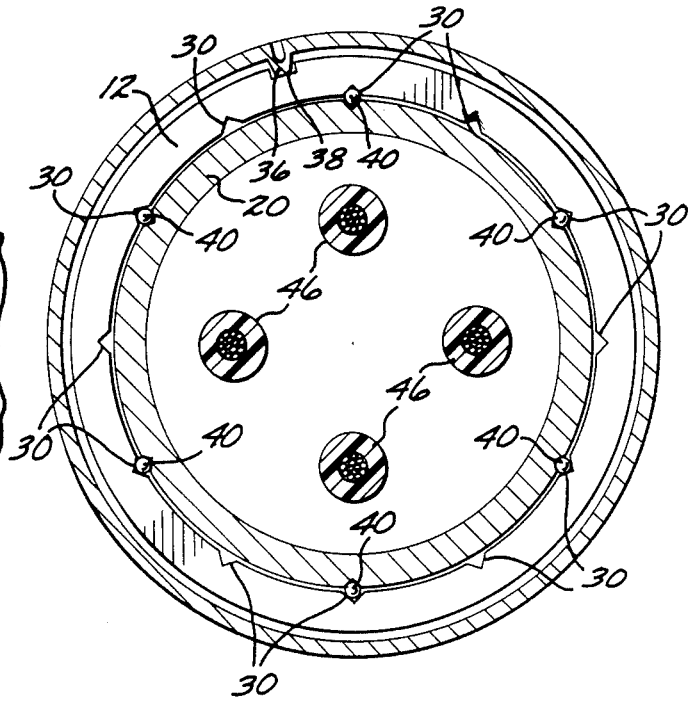
FIG. 4 is a cross-sectional view along line 4—4 of FIG. 3.

As shown in FIGS. 1, 3, and 4, the retainer ring 12 has an inner peripheral edge that is provided with a plurality of equidistantly-spaced radial indentations or notches 30 which, as will be described below, function as detents in a ratcheting mechanism. As in conventional end bells, the coupling ring 14 is concentrically mounted around the annular fitting 20, with the interior surface of the coupling ring 14 fitting around the exterior surface of the annular fitting 20 so as to be rotatable thereon. The exterior surface of the annular fitting 20 has a first circumferential groove 32 which registers with a second circumferential groove 34 in the interior surface of the coupling ring 14. The inner peripheral edge of the retainer ring is seated in the first groove 32, and the outer peripheral edge of the retainer ring is seated in the second groove 34 By this arrangement, the coupling ing 14 can be rotated around the annular fitting 20, but relative axial movement between the two components is substantially prevented.

Relative rotational movement between the coupling ring 14 and the retainer ring 12 is substantially prevented by the engagement of an inward protrusion 36 on the interior surface of the coupling ring with an outer notch 38 in the outer peripheral edge of the retainer ring, as shown in FIG. 4. This arrangement ensures that the coupling ring and the retainer ring rotate together as a unit. The protrusion 36 is preferably coined into the outer notch 38 by a punch or the like applied to the exterior surface of the coupling ring 14.

As shown in FIGS. 3 and 4, the annular fitting 20 is provided with a plurality of rotational bearing elements 40 in the groove 32. In the preferred embodiment of the invention, the bearing elements 40 are ball bearings, each disposed in an individual socket in the groove 32, and spaced equidistantly around the periphery of the annular fitting 20. Other types of rotational bearings, such as roller bearings, can be used instead of ball bearings. In any event, the bearings 40 should be disposed so as to protrude from the groove 32, thereby to be engageable with the retainer ring 12 and its detent notches 30. In the preferred embodiment illustrated in the drawings, there are six bearings 40 and twelve detent notches 30. These numbers can be varied, but for best results, the number of detents should be no less than the number of bearings, and there should be at least three bearings. The detent notches 30, engaged by the bearings 40, provide a plurality of detented rotational positions for the coupling ring 14, thereby creating a ratcheting action as the coupling ring and the retainer ring are rotated together with respect to the annular fitting.

In use, the end bell of the present invention is attached to the distal end of the connector in the usual manner, by threading the coupling ring 14 onto the externally threaded connector receptacle 16. The distal edge of the connector receptacle 16 is provided with a plurality of prongs or teeth 42 that engage the serrated edge 28 of the annular fitting 20. This engagement prevents the fitting from slipping as the coupling ring is tightened.

Continued tightening of the coupling ring 14 after the teeth 42 engage the serrated fitting edge 28 causes the retainer ring 12 to slip around the annular fitting 20 with the ratcheting action created by the sequential engagement of the detent notches 30 with the bearings 40, as described above. This ratcheting action continues until the coupling ring is fully tightened. As shown in FIG. 3, the distal end of the connector receptacle contains an elastomeric, insulating plug or seal 44, which, in turn, is channelled through to receive a plurality of cables 46. The distal end of the elastomeric seal 44 protrudes slightly from receptacle 16, so that it is engaged and compressed by the annular fitting 20 as the coupling ring is tightened.

Figure 2:
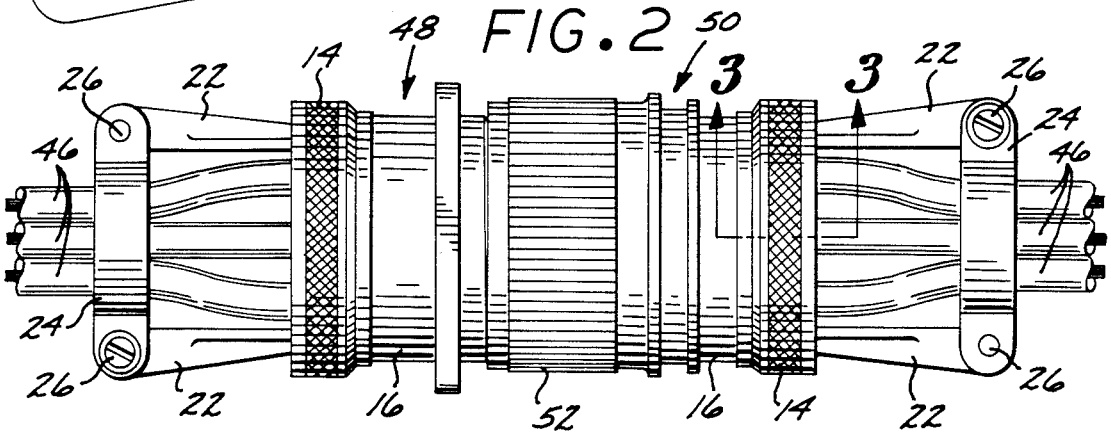
FIG. 2 is a top plan view of an electrical cable connector assembly with end bells in accordance with the present invention attached.

A fully assembled connector assembly is shown in FIG. 2. As illustrated, a male connector 48 and a female connector 50 are mated together and secured by an annular coupling nut 52, in the usual manner. Each connector has a receptacle 16, to the distal end of which is attached an end bell in accordance with the present invention. After the end bells are attached, in the manner described above, the strain relief cable clamps 24 are screwed into placed in the conventional manner.

The ratcheting action described above provides a self-locking or anti-decoupling attachment between the end bell and the connector. Specifically, the ratcheting action, as previously described, is a result of the multiple detented rotational positions for the coupling ring 14 and the retainer ring 20, which turn as a unit due to the engagement between the protrusion 36 and the notch 38, as mentioned above. Because these multiple rotational positions are detented, the coupling ring is restrained from "backing off", or turning in a loosening or decoupling direction, as a result of vibration or physical shock. Moreover, this ratcheting effect allows the coupling nut to be more tightly fastened against the elastomeric seal 44 of the connector, with less likelihood of being loosened by the pressure of the compressed seal. The net result is a tighter connection between the end bell and the connector receptacle than has heretofore been possible, with far more resistance to vibration- or shock-induced decoupling. Neverthelss, only a moderate manual effort is needed to couple and decouple the end bell from the connector.

The advantages described above are achieved with a structure that is relatively simple and economical to manufacture, and that remains reliable through extended periods of repeated use. It will also be appreciated that an end bell constructed in accordance with the present invention is not appreciably greater in external dimension (particularly outside diameter) than a conventional end bell for the same size connector. This feature has particular importance in retrofit applications, obviating the need for extensive modifications of the structural panels and the like which accommodate these connector assemblies.

While a preferred embodiment of the invention has been described, it will be appreciated that various modifications will suggest themselves to those skilled in the pertinent arts. For example, as mentioned above, the number of detents and bearings, and their configurations, may be varied to suit specific applications or design considerations. Furthermore, the means for preventing relative rotation between the coupling ring and the retainer ring may assume a number of forms, the coined protrusion and notch embodiment disclosed herein being preferred for its relative simplicity of fabrication. For example, a pin may used to secure the two rings to each other. These and other variations should be considered within the spirit and scope of the invention, as defined by the claims which follow.

What is claimed is:

1. A self-locking strain-relief end bell for an electrical connector assembly, comprising:

strain relief means, including an annular fitting having an exterior surface;

a coupling ring having an interior surface dimensioned to fit around the exterior surface of said annular fitting; and ratcheting means, engaging the exterior surface of said annular fitting and the interior surface of said coupling ring, for (a) restraining the relative axial movement of said coupling ring and said annular fitting, while (b) providing a plurality of detented rotational positions as said coupling ring is rotated relative to said annular fitting, said ratcheting means comprising:

a retainer ring having an inner peripheral edge and an outer peripheral edge, said inner peripheral edge having a plurality of detent-defining radial indentations at substantially equidistant intervals thereon;

first seating means, on the exterior surface of said annular fitting, for seating the inner peripheral edge of said retainer ring;

second seating means, on the internal surface of said coupling ring, for seating the outer peripheral edge of said retainer ring; and a plurality of ball bearings retained in said first seating means at substantially equidistant intervals by said retainer ring, said ball bearings engaging said detents defined by said radial indentations as said coupling ring is rotated relative to said annular fitting.

2. The end bell of claim 1, further comprising: anti-rotation means, in said second seating means, for engaging the outer peripheral edge of said retainer ring so as to restrain the relative rotation of said coupling ring and said retainer ring as said coupling ring is rotated relative to said annular fitting.

3. The end bell of claim 1, wherein said first seating means is a first circumferential groove in the exterior surface of said annular fitting, said second seating means is a second circumferential groove in the interior surface of said coupling ring, the inner peripheral edge of said retainer ring being seated in said first groove and the outer peripheral edge of said retainer ring being seated in said second groove.

4. The end bell of claim 3, wherein each of said ball bearings being retained in a socket in said first groove.

5. The end bell of claim 1, wherein the number of said detents is at least equal to the number of said ball bearings.

6. The end bell of claim 5, wherein the number of said detents is greater than the number of said ball bearings.

7. The end bell of claim 1, wherein said annular fitting includes a serrated proximal edge and a distal edge having a pair of axially-extending, diametrically-opposed ears adapted for the attachment of strain relief cable-clamping means.

8. A strain relief end ball for an electrical connector assembly, of the type including a strain-relief clamp connected to an annular fitting, and a coupling ring rotatably disposed around the exterior surface of said fitting and concentric therewith, wherein the improvement comprises:

a retainer ring, engaged between said fitting and said coupling ring, whereby relative axial movement between said coupling ring and said fitting is substantially restained, said retainer ring having an inner peripheral edge;

anti-rotation means, engaging said retainer ring and said coupling ring, for restraining the relative rotation of said coupling ring and said retainer ring;

detent-forming means on said retainer ring for defining a plurality of detented rotational positions for said retainer ring relative to said fitting, said detent-forming means comprising a plurality of radial notches formed at substantially equidistant intervals around said inner peripheral edge; and a plurality of ball bearings seated in the exterior surface of said fitting so as to be retained by said retainer ring and engageable with said inner peripheral edge of said retainer ring and with notches formed therein, for providing a ratcheting action between said retainer ring and said fitting as said retainer ring and said coupling ring are rotated relative to said fitting.

9. The end bell of claim 8, wherein said retainer ring has an outer peripheral edge, and wherein said anti-rotation means comprises:

an outer notch formed in said outer peripheral edge; and notch-engaging means in said coupling ring for engaging said outer notch so as to fix said retainer ring positionally with respect to said coupling ring, thereby allowing said coupling ring and said retainer ring to be rotated as a unit with respect to said annular fitting.

10. The end bell of claim 8, wherein said retainer ring has an outer peripheral edge seated in a groove in the interior surface of said coupling ring, and an inner peripheral edge seated in a groove in the exterior surface of said annular fitting.

11. A self-locking, strain-relief end bell for an electrical connector assembly, comprising:

strain-relief clamping means connected to an annular fitting having an exterior surface with a first circumferential groove;

a coupling ring having an interior surface dimensioned to fit rotatably around the exterior surface of said annular fitting so as to be concentric therewith, said interior surface having a second circumferential groove;

a retainer ring having an inner peripheral edge seated in said first groove, and an outer peripheral edge seated in said second groove;

anti-rotation means engaging said coupling ring and said retainer ring, whereby said coupling ring and said retainer ring are rotatable as a unit with respect to said annular fitting;

a plurality of radial notches formed at substantially equidistant intervals around the inner peripheral edge of said retainer ring; and a plurality of rotational bearings disposed in said first groove so as to be engageable with the inner peripheral edge of said retainer ring and with said notches formed therein as said retainer ring and said coupling ring are rotated with respect to said annular fitting.

12. The end bell of claim 11, wherein said anti-rotation means comprises:

an outer notch formed in the outer peripheral edge of said retainer ring; and means protruding from the interior surface of said coupling ring and engaging said outer notch to restrain relative rotational movement between said retainer ring and said coupling ring.

13. The end bell of claim 11, comprising at least three of said ball bearings and at least three of said radial notches.

* * * * *

UNITED STATES PATENT AND TRADEMARK OFFICE

CERTIFICATE OF CORRECTION

PATENT NO. : 4,808,123

DATED : February 28, 1989

INVENTOR(S) : James S. Dee and Thomas J. Bell

It is certified that error appears in the above-identified patent and that said Letters Patent is hereby corrected as shown below:

Column 1, line 41 "connector assemblies have met with varying degrees of" should be added after "for";

Column 2, line 33 "relative axial movement between the coupling ring and the" should be added after "that".

Column 8, line 4 "rotational" should be --ball--.

Signed and Sealed this

Sixth Day of November, 1990

*Attest:*

*Attesting Officer*

HARRY F. MANBECK, JR.

*Commissioner of Patents and Trademarks*